United States Patent [19]

Lisiecki

[11] Patent Number: 4,572,426

[45] Date of Patent: Feb. 25, 1986

[54] PAPERBOARD CONTAINER WITH INTERNAL RAW EDGE PROTECTION AND METHOD FOR CONSTRUCTING SAME

[75] Inventor: Robert E. Lisiecki, Orchard Lake, Mich.

[73] Assignee: Ex-Cell-O Corporation, Troy, Mich.

[21] Appl. No.: 601,769

[22] Filed: Apr. 18, 1984

[51] Int. Cl.[4] ..... B65D 57/42

[52] U.S. Cl. ..... 229/48 SA; 229/48 SB; 229/48 T

[58] Field of Search ..... 229/48 SA, 48 SB, 48 SC, 229/48 T

[56] References Cited

U.S. PATENT DOCUMENTS

| | | | |
|---|---|---|---|
| 3,307,738 | 3/1967 | Scheindel | 229/48 T |
| 3,414,184 | 12/1968 | Loheed | 229/48 SA |
| 3,456,863 | 7/1969 | Mollison et al. | 229/48 SA |
| 3,604,613 | 9/1971 | Haas | 229/48 T |
| 3,951,332 | 4/1976 | Torbeck | 229/48 SA |
| 4,239,150 | 12/1980 | Schadowski et al. | 229/48 T |
| 4,292,386 | 9/1981 | Takano | 229/48 T |
| 4,315,571 | 2/1982 | Danne | 229/48 SA |

*Primary Examiner*—Joseph Man-Fu Moy
*Attorney, Agent, or Firm*—John P. Moran

[57] ABSTRACT

There is disclosed a container structure including a sealed side seam having a protected internal raw edge, and a method for accomplishing same. The method includes skiving or cutting a side seam flap along a taper to a feather edge, applying a sealant to the skived surface, and pressing the sealant-covered strip under heat and pressure into contact with the inside surface of the adjacent side wall panel to become sealed thereto without an exposed internal raw edge. Alternatively, the sealant may be applied to the side wall panel adjacent the skived tapered surface.

6 Claims, 9 Drawing Figures

PAPERBOARD CONTAINER WITH INTERNAL RAW EDGE PROTECTION AND METHOD FOR CONSTRUCTING SAME

TECHNICAL FIELD

This invention relates generally to thermoplastic-coated paperboard containers and, more particularly to containers with internal raw edge protection, and the process for constructing same.

BACKGROUND ART

Various industries have found that central packaging for distant markets is a beneficial approach in their business activity and can assist them in developing strong market bases. There is an increased emphasis on volume producing and marketing. Product markets may extend across international boundaries. Thus, out of both necessity and convenience, situations have developed where individual producers may service vast market areas. Hence, longer shelf life, particularly for difficult-to-contain liquids, is needed so that producers and suppliers can provide uniform top quality merchandise throughout expanded areas of distribution.

It is well known that the incorporation of a layer of aluminum foil generally serves as a means of preventing oxygen and ultra violet light rays from penetrating through the walls of a paperboard container. However, when longer than normal shelf life is desired, additional precautions must be taken to assure better resistance to edge wicking resulting in wall bulge and/or liquid staining through the wall of the paperboard container.

Heretofore, internal raw edges have been eliminated in various ways. The edge portions of internal side seam panels have been folded double with the raw edge half confined adjacent the outer wall panel, as disclosed in Miller et al U.S. Pat. No. 3,294,310. Other known techniques have included "skiving" or cutting away a portion of the thickness of the side seam panel edge portion so that, when folded onto the adjacent unskived wall, the overall thickness thereof is less than double thickness, as disclosed in Braun U.S. Pat. No. 3,604,317. Schwenk U.S. Pat. No. 3,654,842 illustrates a method of skiving wherein the skived portion only is folded double to thereby eliminate the raw edge while maintaining a single wall thickness.

Still other techniques have included various applicator mechanisms and methods whereby the raw edges of sheet material, before being cut into individual blanks, are covered with a suitable thermoplastic sealing material, as shown and described in Battersby et al U.S. Pat. No. 3,213,890, Stamp et al U.S. Pat. No. 3,664,296, and Replogle U.S. Pat. No. 1,316,805.

In addition to the above, McNair, Jr. et al U.S. Pat. No. 3,365,111 illustrates in FIGS. 8A and 8B thereof a container wall panel having an edge portion skived on an angle, but with layers of polyethylene, aluminum foil and polyethylene extending beyond the angled edge and folded onto the adjacent wall panel so as to be sealed thereto.

DISCLOSURE OF THE INVENTION

Accordingly, a general object of the invention is to provide an improved, economical paperboard container which is capable of improving the shelf life of liquids.

Another object of the invention is to provide a container having an improved wall construction including means for preventing internal edge wicking.

A further object of the invention is to provide a paperboard container wherein the outside edge portion of the side seam flap is "skived" or shaved to a feather edge, has a suitable sealant applied thereto, and is then pressed into contact with the inside surface of the adjacent overlapped panels, thereby eliminating raw edges from the inside surfaces of the container.

These and other objects and advantages of the invention will be apparent when reference is made to the following description and accompanying drawings, wherein:

BEST MODE OF CARRYING OUT THE INVENTION

Figure 1:
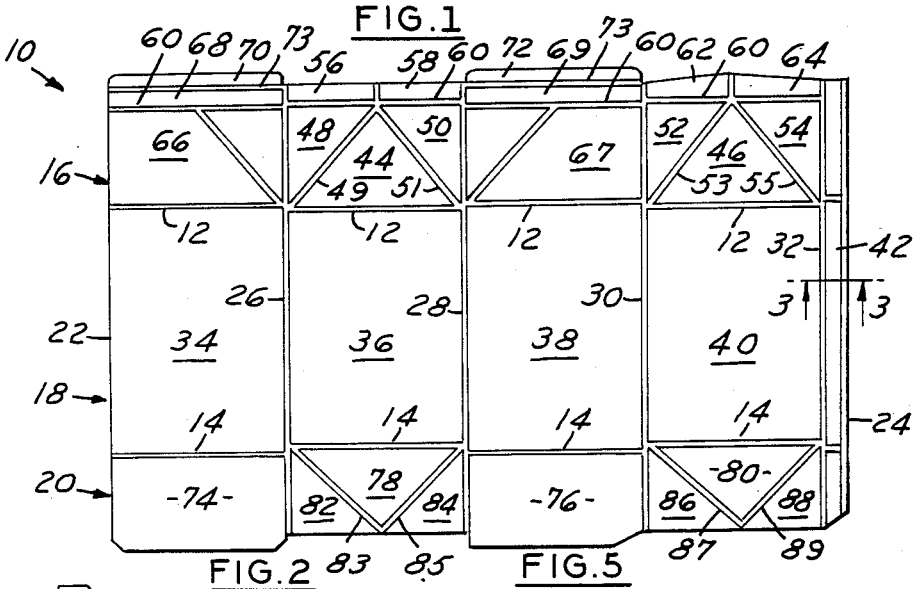
FIG. 1 is a layout view of the outside surface of a container blank body, to which the present invention could be adapted.

Referring now to the drawings in greater detail, FIG. 1 illustrates the outside surface of a container blank 10. The container blank 10 is separated into three general groups by staggered score lines 12 and 14. The group above staggered score line 12 is referred to as top closure group 16. The group between staggered score lines 12 and 14 are referred to as body group 18. The group below staggered score line 14 is referred to as bottom closure group 20. The container blank 10 is defined on its sides by side edges 22 and 24 and is separated vertically by a series of score lines 26, 28, 30 and 32. The score lines 26, 28, 30 and 32 divide the group body 18 into side wall panels 34, 36, 38 and 40 and side seam flap 42.

The top closure group 16 is mounted on the upper end of body group 18. Triangular end panels 44 and 46 are connected to upper ends of the side wall panels 36 and 40, respectively, by the score line 12. The triangular end panel 44 has a pair of adjacent fold-back panels 48 and 50 mounted on its upper sides and separated therefrom by diagonal score lines 49 and 51, and the triangular end panel 46 has a pair of fold-back end panels 52 and 54 mounted on its upper sides, separated therefrom by diagonal score lines 53 and 55. A pair of inner rib panels 56 and 58 are connected to the fold-back panels 48 and 50, respectively, by a score line 60. A pair of inner rib panels 62 and 64 are connected to the fold-back panels 52 and 54, respectively, by the score line 60.

A pair of roof panels 66 and 67 are connected to the body group 18 at the upper end of the side wall panels 34 and 38, respectively, by the score line 12. A pair of inner rib panels 68 and 69 are connected to the roof panels 66 and 67, respectively, by the score line 60. A pair of outer sealing rib panels 70 and 72 are connected to the upper end of the inner rib panels 68 and 69, respectively, by spaced score lines 73. A complete description of the top closure group 16 is not necessary to understand the principles of the present invention. However, reference is made to U.S. Pat. No. 3,270,940 which issued Sept. 6, 1966 for a complete description of a top closure group similar to the top closure group 16.

The bottom closure group 20 is mounted on the lower end of the body group 18. A tuck-in panel 74 and a overlap panel 76 are connected to the lower ends of the side wall panels 34 and 38, respectively, along the staggered score line 14.

A first triangular panel 78 and second triangular panel 80 are connected to the bottom of the side wall panels 36 and 40, respectively, along the staggered score line 14. A first pair of fold-back panels 82 and 84 are connected to the first triangular panel 78 adjacent the tuck-in panel 74 and the overlap panel 76, respectively, by diagonal score lines 83 and 85. A second pair of fold-back panels 86 and 88 are connected to the second triangular panel 80 by diagonal score lines 87 and 89 adjacent the overlap panel 76 and the lower end of the side seam flap 42.

Figure 2:
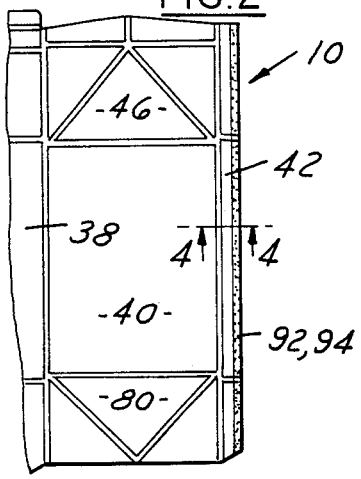
FIG. 2 is a fragmentary view of a portion of the FIG. 1 structure after an operational step has been performed thereon.
Figure 3:
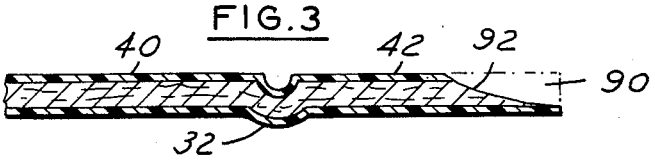
FIGS. 3, 4, 6 and 8 are enlarged fragmentary cross-sectional views taken along lines 3—3, 4—4, 6—6 and 8—8, respectively of FIGS. 1, 2, 5 and 6, and looking in the directions of the respective arrows.
Figure 4:
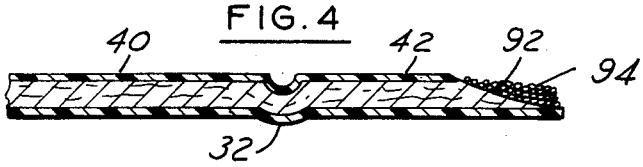
Figure 7:
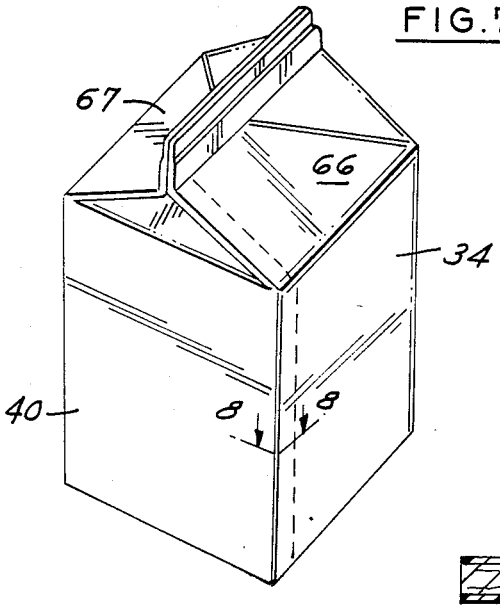
FIG. 7 is a perspective view of a container fabricated from the blanks shown in FIGS. 1 and 2.
Figure 4A:
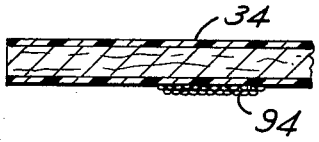
FIG. 4A is an alternate embodiment with respect to FIG. 4 which, like FIG. 4, results in the closure relationship with an adjacent panel, as shown in FIG. 6.

Referring now to FIGS. 3 and 4, it is noted in FIG. 3 that a strip 90, which is substantially triangular in cross-section, has been removed or "skived" in any suitable manner from the outside edge portion of the side seam flap 42, leaving a tapered raw paperboard surface 92. As shown in FIG. 4, the raw paperboard surface 92 is then covered with a suitable sealant, represented as 94, by any convenient method. FIG. 1 illustrates the side seam flap 42 after the skiving operation has been performed thereon, FIG. 2 represents the skived side seam flap 42 after having the sealant 94 applied thereto. Alternatively, rather than applying the sealant 94 to the surface 92, the sealant 94 may be applied to a predetermined width along the full length of the side wall panel 34, as shown in FIG. 4A, and the associated aligned portions of the top panel segments 66, 68 and 70, and the bottom panel 74. If desired, both the tapered surface 92 and the width of panels 34, 66, 68 and 70 may have the sealant 94 applied thereto.

When the container blank 10 is being prepared for assembly as a container it is side seamed (FIG. 5) by having the top triangular end panel 46 and related panel segments, the side wall panel 40 and the bottom triangular panel 80 and related panel segments all rotated about the score line 30 such that their inside surfaces contact the inside surfaces of the roof panel 67 and related panel segments, the side wall panel 38 and the overlap panel 76, with the side seam flap 42 extending past the score line 28, adjacent the edge portions of the side wall panel 36, the top panels 44, 50 and 58, and the bottom panels 78 and 84.

The roof panel 66, the segments 68 and 70, the side wall panel 34 and the tuck-in panel 74 are folded about the score line 26, bringing their inside surfaces into contact with the inside surfaces of the triangular end panel 44 and related panel segments, the side wall panel 36 and the triangular panel 78 and related panel segments, and the outside surface of the side seam flap 42. The side edge 22 is substantially aligned with the score line 28, and the associated edge portions of the panels 34, 66, 68, 70 and 74 are in contact with the outside surface of the side seam flap 42. The entire outside surface of side seam flap 42 is then secured to the inside surface of the latter panel edge portions. This can be accomplished in many ways. One of the preferred methods is heat sealing which will establish a surface bond between the respective members. The container blank 10 can then be opened into tubular form, preparatory to having the bottom closure group 20 formed and sealed, as described in detail in U.S. Pat. No. 3,120,335.

Figure 5:
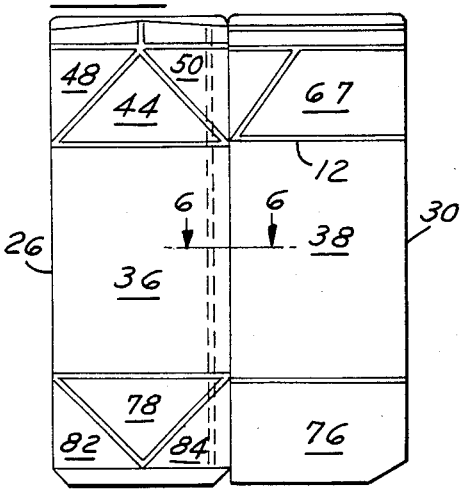
FIG. 5 is a flat side seamed blank made from the container blank shown in FIG. 1, and showing the outside surface thereof.
Figure 6:
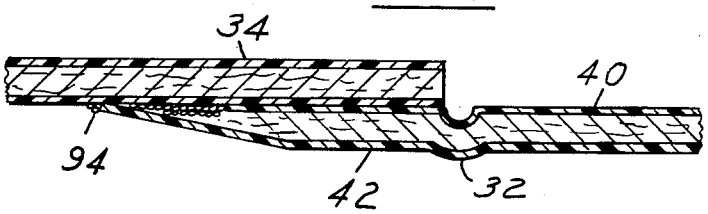

Referring now to FIG. 6, it is noted that the sealant-covered raw paperboard surface 92 is bent toward and pressed into sealing engagement with the adjacent panel surface. This occurs during the above-referenced heat sealing operation, while the side seam sealed blank of FIG. 5 is being formed. In other words, the pressure applied to form the folded blank of FIG. 5 has been found to be sufficient to force the sealant-covered tapered edge 92 into sealing contact with the adjacent portions of panels 34, 66, 68, 70 and 74. Similarly, it is believed that sealing would occur during the heat sealing operation if the sealant 94 were on the above-described width of panels 34, 66, 68, 70 and 74, in lieu of being on the side seam flap 42.

Figure 8:
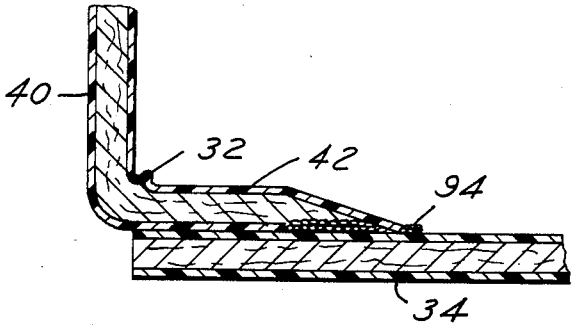

Once the bottom closure group 20 is closed and sealed, the resultant tubular container is filled with a liquid, and then the top closure group 16 is closed, to form the filled container illustrated in FIG. 3. The forming of the side seam blank and the closing of the top closure group is covered in detail in the above mentioned U.S. Pat. No. 3,270,940. As may be noted in FIG. 8, when completed, there are no raw edges on the inside wall of the container.

Industrial Applicability

It should be apparent that the invention provides an improved liquid-carrying container wherein raw edges are eliminated from the inside wall thereof to thus prevent edge wicking and, hence, readying the container for a longer shelf life than if inner raw paperboard edges were exposed.

While but one embodiment of the invention has been shown and described, other modifications thereof are possible.

The embodiments of the invention in which an exclusive property or privilege is claimed are defined as follows:

1. The method of forming and sealing the side seam of a container formed from a blank of thermoplastic covered paperboard and including seriatim first, second, third and fourth side wall panels and a side seam flap, said method comprising the following steps:

(a) skiving a strip on the outer surface of said side seam flap adjacent the free edge thereof on a taper to a substantially feather edge;

(b) applying sealant to at least one of said skived strip and the area of the inside surface of the first side wall panel adapted to being directly opposite said skived strip; and (c) bending skived strip toward said inside surface of the first side wall panel and pressing same under heat and pressure into contact therewith to become secured thereto by said sealant without an exposed internal raw edge.

2. The method described in claim 1, wherein the sealant is applied to said skived strip.

3. The method described in claim 1, wherein the sealant is applied to the area of the side wall panel adapted to being directly opposite said skived strip.

4. A collapsed container formed from a one-piece thermoplastic coated paperboard blank, said container comprising:

(a) first, second, third and fourth interconnected side wall panels and a side seam flap connected to said fourth side wall panel;

(b) a plurality of top closure panels connected respectively to the upper ends of the four side wall panels and said side seam flap;

(c) a plurality of bottom closure panels connected respectively to the lower ends of the four side wall panels and said side seam flap;

(d) a skived tapered strip formed on the edge portion of said side seam flap and its associated top and bottom closure panels;

(e) a layer of sealant applied to at least one of said skived tapered strip and a strip along the length of said first side wall panel and its associated top and bottom closure panels opposite said skived tapered strip;

(f) two of said side wall panels being folded into overlapping relation to the remaining two side wall panels; and (g) a bend formed at the inner edge of said skived tapered strip of said side seam flap such that the skived surface of said skived tapered strip is secured to said first side wall panel along said at least one of said sealant-covered strips to form a lap side seam.

5. The collapsed container described in claim 4, wherein said sealant is applied to said skived tapered strip.

6. The collapsed container described in claim 4, wherein said sealant is applied to said strip along the length of said first side wall panel.

* * * * *